US012247309B2

(12) United States Patent
Kim et al.

(10) Patent No.: US 12,247,309 B2
(45) Date of Patent: Mar. 11, 2025

(54) FERRITIC STAINLESS STEEL HAVING IMPROVED CORROSION RESISTANCE, AND MANUFACTURING METHOD THEREFOR

(71) Applicant: POSCO, Pohang-si (KR)

(72) Inventors: Kwang Min Kim, Pohang-si (KR); Kkoch Nim Oh, Gwangju (KR); Dong-Hoon Kim, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 672 days.

(21) Appl. No.: 17/296,300

(22) PCT Filed: Nov. 1, 2019

(86) PCT No.: PCT/KR2019/014743
§ 371 (c)(1),
(2) Date: May 24, 2021

(87) PCT Pub. No.: WO2020/111546
PCT Pub. Date: Jun. 4, 2020

(65) Prior Publication Data

US 2022/0010451 A1 Jan. 13, 2022

(30) Foreign Application Priority Data

Nov. 29, 2018 (KR) ..... 10-2018-0151017

(51) Int. Cl.
*C22C 38/00* (2006.01)
*C22C 38/02* (2006.01)
(Continued)

(52) U.S. Cl.
CPC ..... *C25D 11/38* (2013.01); *C22C 38/001* (2013.01); *C22C 38/004* (2013.01); *C22C 38/02* (2013.01);
(Continued)

(58) Field of Classification Search
CPC ..... C22C 38/001; C22C 38/004; C22C 38/02; C22C 38/04; C22C 38/48; C22C 38/50
(Continued)

(56) References Cited

U.S. PATENT DOCUMENTS

2013/0337289 A1 12/2013 Hatano et al.
2018/0219201 A1 8/2018 Kim et al.
(Continued)

FOREIGN PATENT DOCUMENTS

CA 2997544 A1 3/2017
CA 3026612 A1 12/2017
(Continued)

OTHER PUBLICATIONS

Japanese Office Action dated Sep. 27, 2022 issued in Japanese Patent Application No. 2021-531291 (with English translation).
(Continued)

*Primary Examiner* — Katherine A Christy
(74) *Attorney, Agent, or Firm* — Morgan, Lewis & Bockius LLP

(57) ABSTRACT

A ferritic stainless steel with improved corrosion resistance. The ferritic stainless steel with improved corrosion resistance according to an embodiment of the present disclosure includes, in percent (%) by weight of the entire composition, C: 0.02% or less (excluding 0), N: 0.02% or less (excluding 0), Si: 0.5% or less (excluding 0), Mn: 0.3% or less (excluding 0), Cr: 16 to 20%, Ni: 0.4% or less (excluding 0), the remainder of iron (Fe) and other inevitable impurities, and a Cr weight % content of a thickness region from a surface of a passivation film to 3 nm is 1.2 times or more than the Cr weight % content of the stainless base material.

10 Claims, 2 Drawing Sheets

(51) Int. Cl.

| | |
|---|---|
| ***C22C 38/04*** | (2006.01) |
| ***C22C 38/48*** | (2006.01) |
| ***C22C 38/50*** | (2006.01) |
| ***C25D 11/38*** | (2006.01) |

(52) U.S. Cl.
CPC ..... *C22C 38/04* (2013.01); *C22C 38/48* (2013.01); *C22C 38/50* (2013.01)

(58) Field of Classification Search
USPC ..... 428/469
See application file for complete search history.

(56) References Cited

U.S. PATENT DOCUMENTS

| | | | | |
|---|---|---|---|---|
| 2019/0226044 | A1* | 7/2019 | Kawagoe ..... | C21D 1/76 |
| 2019/0305328 | A1 | 10/2019 | Yano et al. | |

FOREIGN PATENT DOCUMENTS

| | | | |
|---|---|---|---|
| CN | 1220321 | A | 6/1999 |
| CN | 103429777 | A | 12/2013 |
| CN | 104379790 | A | 2/2015 |
| CN | 104471099 | A | 3/2015 |
| CN | 105431562 | A | 3/2016 |
| CN | 106282833 | A | 1/2017 |
| CN | 106756628 | A | 5/2017 |
| CN | 107925040 | A | 4/2018 |
| JP | H08-060243 | A | 3/1996 |
| JP | H09-87868 | A | 3/1997 |
| JP | H09-143614 | A | 6/1997 |
| JP | 2009-167486 | A | 7/2009 |
| JP | 2010-106305 | A | 5/2010 |
| JP | 2010-127749 | A | 6/2010 |
| JP | 2014-152368 | A | 8/2014 |
| JP | 2015-063733 | A | 4/2015 |
| JP | 2016-191094 | A | 11/2016 |
| JP | 2017-155311 | A | 9/2017 |
| JP | 6323623 | B1 | 5/2018 |
| JP | 2018-145484 | A | 9/2018 |
| KR | 10-2010-0073406 | A | 7/2010 |
| KR | 10-2010-0080379 | A | 7/2010 |
| KR | 10-1788466 | B1 | 10/2017 |
| KR | 10-1798406 | B1 | 11/2017 |
| KR | 10-2018-0067891 | A | 6/2018 |
| TW | 201810784 | A | 3/2018 |
| WO | 2011/114963 | A1 | 9/2011 |

OTHER PUBLICATIONS

Chinese Office Action dated Nov. 18, 2022 issued in Chinese Patent Application No. 201980078602.X (with English translation).
Chinese Office Action dated Apr. 25, 2022 issued in Chinese Patent Application No. 201980078602.X (with English translation).
Canadian Office Action dated May 5, 2022 issued in Canadian Patent Application No. 3,121,216.
Japanese Office Action dated Jun. 7, 2022 issued in Japanese Patent Application No. 2021-531291 (with English translation).
Canadian Office Actiion dated Dec. 16, 2022 issued in Canadian Patent Application No. 3121216.
Canadian Office Action dated Jul. 17, 2023 issued in Canadian Patent Application No. 3,121,216.
International Search Report and Written Opinion dated Mar. 2, 2020 issued in International Patent Application No. PCT/KR2019/014743 (with English translation).
Korean Notice of Allowance dated May 15, 2020 issued in Korean Patent Application No. 10-2018-0151017.
Korean Office action dated Jan. 6, 2020 issued in Korean Patent Application No. 10-2018-0151017.
European Search Report dated Oct. 27, 2021 issued in European Patent Application No. 19889398.4.
Canadian Office Action dated Apr. 18, 2024 issued in Canadian Patent Application No. 3,121,216.
Office Action dated Oct. 9, 2024, issued in corresponding European Patent Application No. 19889398.4.

* cited by examiner

【FIG. 1】
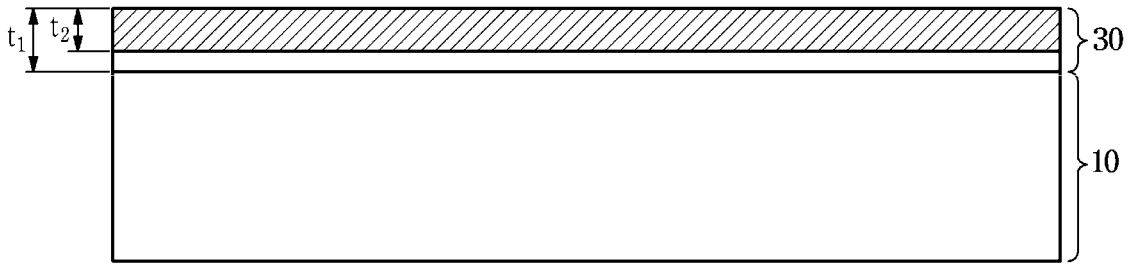

【FIG. 2】
COMPARATIVE EXAMPLE 4
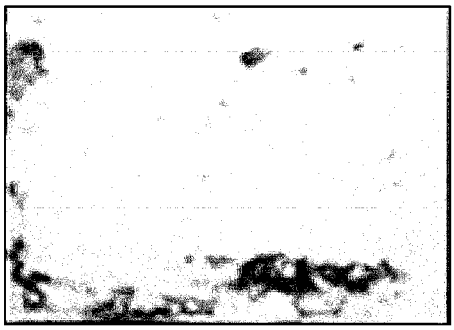
INVENTIVE EXAMPLE 4
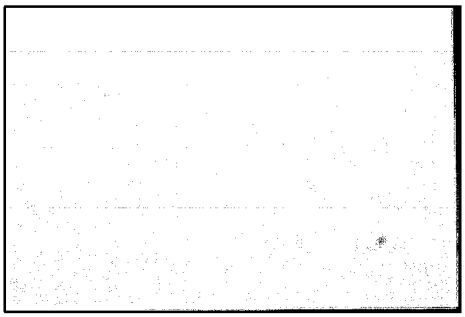

FERRITIC STAINLESS STEEL HAVING IMPROVED CORROSION RESISTANCE, AND MANUFACTURING METHOD THEREFOR

CROSS-REFERENCE OF RELATED APPLICATIONS

This application is the U.S. National Phase under 35 U.S.C. § 371 of International Patent Application No. PCT/KR2019/014743, filed on Nov. 1, 2019, which in turn claims the benefit of Korean Application No. 10-2018-0151017, filed on Nov. 29, 2018, the entire disclosures of which applications are incorporated by reference herein.

TECHNICAL FIELD

The present disclosure relates to a ferritic stainless steel, and in particular, to a ferritic stainless steel with improved corrosion resistance by concentrating Cr on the surface and a manufacturing method thereof.

BACKGROUND ART

A stainless steel refers to a steel that has strong corrosion resistance by suppressing corrosion, which is a weak point of carbon steel. In general, stainless steel is classified according to its chemical composition or metal structure. According to the metal structure, stainless steel can be classified into austenite-based, ferrite-based, martensite-based and dual phase-based.

Among them, austenitic stainless steel has excellent corrosion resistance, so it is applied to materials for construction materials.

In particular, among austenitic stainless steels, studies to improve corrosion resistance by adjusting the content of alloy elements such as Mo, Ni, Nb, Ti, Si, and Zr components or by performing surface treatment such as Al plating are being actively conducted.

However, in this case, there is a problem in that the price competitiveness is lowered due to the addition of expensive alloying elements, and the manufacturing cost and manufacturing time due to the additional process increase, resulting in a decrease in productivity.

On the other hand, in the case of ferritic stainless steel, corrosion resistance is inferior to that of austenitic stainless steel. Therefore, ferritic stainless steel was limited in application to the use of interior and exterior materials in buildings exposed to corrosive conditions.

However, ferritic stainless steel has a significantly lower Ni content, which is an expensive alloying element, so price competitiveness can be secured. Therefore, there is a need to develop ferritic stainless steel that can secure corrosion resistance equal to or higher than that of austenitic stainless steel without adding expensive alloying elements or plating.

DISCLOSURE

Technical Problem

Embodiments of the present disclosure are intended to provide ferritic stainless steel with improved corrosion resistance by controlling the surface component, and a manufacturing method thereof.

Technical Solution

In accordance with an aspect of the present disclosure, a ferritic stainless steel with improved corrosion resistance includes: a stainless base material including, in percent (%) by weight of the entire composition, C: 0.02% or less (excluding 0), N: 0.02% or less (excluding 0), Si: 0.5% or less (excluding 0), Mn: 0.3% or less (excluding 0), Cr: 16 to 20%, Ni: 0.4% or less (excluding 0), the remainder of iron (Fe) and other inevitable impurities; and a passivation film formed on the stainless base material, and the Cr weight % content of the thickness region from the surface of the passivation film to 3 nm is 1.2 times or more than the Cr weight % content of the stainless base material.

The ferritic stainless steel may further include: at least one of Ti: 0.4% or less and Nb: 0.5% or less The ferritic stainless steel may have a pitting potential of 330 mV or more.

The thickness of the passivation film may be 3 to 5 nm.

In accordance with another aspect of the present disclosure, a manufacturing method of a ferritic stainless steel with improved corrosion resistance includes: manufacturing a stainless steel including, in percent (%) by weight of the entire composition, C: 0.02% or less (excluding 0), N: 0.02% or less (excluding 0), Si: 0.5% or less (excluding 0), Mn: 0.3% or less (excluding 0), Cr: 16 to 20%, Ni: 0.4% or less (excluding 0), the remainder of iron (Fe) and other inevitable impurities; forming a chromium-enriched layer on a surface of the stainless steel; and immersing in nitric acid or mixed acid solution including nitric acid and hydrofluoric acid.

The forming the chromium-enriched layer may include: performing electrolytic treatment in sulfuric acid solution having a concentration of 10 to 20%.

The current density of the electrolytic treatment may be 0.1 to 0.6 $A/cm^2$.

The forming the chromium-enriched layer may include: immersing in hydrochloric acid solution at concentration of 10 to 15% for 20 to 40 seconds.

The concentration of the nitric acid solution may be 10 to 20%.

The mixed acid solution may be prepared with nitric acid at concentration of 10 to 20% and hydrofluoric acid at concentration of 5% or less.

The Cr weight % content of the thickness region from the surface of the passivation film to 3 nm may be 1.2 times or more than the Cr weight % content of the stainless base material.

Advantageous Effects

According to an embodiment of the present disclosure, it is possible to provide a ferritic stainless steel with improved corrosion resistance and a manufacturing method thereof.

DESCRIPTION OF DRAWINGS

FIG. 1 is a cross-sectional view of a ferritic stainless steel according to an embodiment of the present disclosure.

FIG. 2 is a view showing a surface state after a salt spray test of an Inventive Steel and a Comparative Steel according to an embodiment of the present disclosure.

BEST MODE

A ferritic stainless steel with improved corrosion resistance according to an embodiment of the present disclosure includes: a stainless base material comprising, in percent (%) by weight of the entire composition, C: 0.02% or less (excluding 0), N: 0.02% or less (excluding 0), Si: 0.5% or less (excluding 0), Mn: 0.3% or less (excluding 0), Cr: 16 to 20%, Ni: 0.4% or less (excluding 0), the remainder of iron (Fe) and other inevitable impurities; and a passivation film formed on the stainless base material, and the Cr weight % content of the thickness region from the surface of the passivation film to 3 nm is 1.2 times or more than the Cr weight % content of the stainless base material.

MODES OF THE INVENTION

Hereinafter, the embodiments of the present disclosure will be described in detail with reference to the accompanying drawings. The following embodiments are provided to transfer the technical concepts of the present disclosure to one of ordinary skill in the art. However, the present disclosure is not limited to these embodiments, and may be embodied in another form. In the drawings, parts that are irrelevant to the descriptions may be not shown in order to clarify the present disclosure, and also, for easy understanding, the sizes of components are more or less exaggeratedly shown.

Also, when a part "includes" or "comprises" an element, unless there is a particular description contrary thereto, the part may further include other elements, not excluding the other elements.

An expression used in the singular encompasses the expression of the plural, unless it has a clearly different meaning in the context.

Hereinafter, embodiments according to the present disclosure will be described in detail with reference to the accompanying drawings.

In general, a ferritic stainless steel has a low Ni content, so Cr plays a decisive role in securing corrosion resistance. Cr on the surface of stainless steel combines with oxygen in the air to form an oxide film with a thickness of several nm. However, the oxide film formed on the surface has a lower Cr concentration than that of the base material and is not suitable for use in applications requiring corrosion resistance.

On the other hand, Fe on the surface of stainless steel is preferentially dissolved compared to Cr because it has a relatively low thermodynamic stability compared to Cr. Based on these characteristics, the present inventors attempted to improve the corrosion resistance of ferritic stainless steel by maximizing the surface Cr content in the range where there is no surface damage due to dissolution of Fe.

FIG. 1 is a cross-sectional view of a ferritic stainless steel according to an embodiment of the present disclosure.

Referring to FIG. 1, a ferritic stainless steel according to an embodiment of the present disclosure includes a stainless base material 10 and a passivation film 30 formed on the stainless base material 10.

The ferritic stainless steel base material with improved corrosion resistance according to an embodiment of the present disclosure includes: a stainless base material comprising, in percent (%) by weight of the entire composition, C: 0.02% or less (excluding 0), N: 0.02% or less (excluding 0), Si: 0.5% or less (excluding 0), Mn: 0.3% or less (excluding 0), Cr: 16 to 20%, Ni: 0.4% or less (excluding 0), the remainder of iron (Fe) and other inevitable impurities.

Hereinafter, the reason for limiting the numerical value of the content of the alloying component in the embodiment of the present disclosure will be described. Hereinafter, unless otherwise specified, the unit is% by weight.

The content of C is 0.02% or less (excluding 0).

Carbon (C) is an interstitial solid solution strengthening element and improves the high temperature strength of ferritic stainless steel. However, if the content is excessive, it reacts with Cr to form chromium carbide, thereby lowering corrosion resistance and at the same time lowering elongation and weldability, so the upper limit can be limited to 0.02%.

The content of N is 0.02% or less (excluding 0).

Nitrogen (N), like carbon, is an interstitial solid solution strengthening element that not only improves the strength of ferritic stainless steel, but also can replace Ni as an element that stabilizes the austenite phase, and improves pitting resistance. However, if the content is excessive, there is a problem that the workability such as elongation is poor, so the upper limit can be limited to 0.02%.

The content of Si is 0.5% or less (excluding 0).

Silicon (Si) is an element added for deoxidation of molten steel and stabilization of ferrite during steel making. In addition, it improves oxidation resistance and improves corrosion resistance by reinforcing the passivation film in stainless steel. However, if the content is excessive, the elongation of the steel decreases, and the upper limit may be limited to 0.5%.

The content of Mn is 0.3% or less (excluding 0).

Like nitrogen, manganese (Mn) is an austenite-phase stabilizing element, and can be added by replacing Ni in terms of corrosion resistance. However, if the content is excessive, the austenite phase is metastabilized, thereby increasing the strength and lowering the workability, and the upper limit may be limited to 0.3%.

The content of Cr is 16 to 20%.

Chromium (Cr) is a ferrite stabilizing element and serves to promote oxide formation on the surface of ferritic stainless steel. In the present disclosure, more than 16% can be added to ensure corrosion resistance equal to or higher than 304 austenitic stainless steel by causing surface Cr concentration. However, if the content is excessive, there is a problem that sticking defects occur due to the generation of dense oxidized scale during hot rolling, and the corrosion resistance of the steel can be sufficiently secured, thereby saturating the Cr concentration effect on the surface. Therefore, it can be limited to 20%.

The pitting potential is used as a method of evaluating the corrosion resistance of stainless steel. Existing high-Cr stainless steel with 25% or more Cr has a pitting potential of 1V or more regardless of whether or not the surface is modified. Therefore, the effect of improving corrosion resistance by surface modification is saturated unless it is a very severe corrosive environment. However, for stainless steel with 20% or less Cr, it is meaningful to improve corrosion resistance by surface modification.

Ni: 0.4% or less (excluding 0).

Nickel (Ni) is an austenite stabilizing element, which is inevitably imported from scrap iron in the steel making process, and is managed as an impurity in the present disclosure. Ni is an element that stabilizes the austenite phase, such as C and N, and is an element that improves corrosion resistance by slowing the corrosion rate, but it is expensive, so it is preferable to limit its upper limit to 0.4% in consideration of economical efficiency.

In addition, the ferritic stainless steel base material with improved corrosion resistance according to an embodiment of the present disclosure may further include one or more of Ti: 0.4% or less and Nb: 0.5% or less in weight %.

The content of Ti is 0.4% or less (excluding 0).

Titanium (Ti) plays a role of inhibiting grain growth by forming carbonitrides by combining with interstitial elements such as carbon (C) and nitrogen (N). However, if the content is excessive, there is a difficulty in the manufacturing process due to Ti inclusions, and there is a problem in that toughness is deteriorated, and the upper limit may be limited to 0.4%.

The content of Nb is 0.5% or less (excluding 0).

Niobium (Nb) is combined with interstitial elements such as carbon (C) and nitrogen (N) to form carbonitrides, thereby suppressing grain growth. However, if the content is excessive, Laves precipitates are formed, resulting in deterioration of formability and brittle fracture, and there is a problem in that toughness is deteriorated, and the upper limit may be limited to 0.5%.

The remaining component of the present disclosure is iron (Fe). However, since unintended impurities from the raw material or the surrounding environment may inevitably be mixed in the normal manufacturing process, this cannot be excluded. Since these impurities are known to anyone of ordinary skill in the manufacturing process, all the contents are not specifically mentioned in the present specification.

FIG. 1 is a cross-sectional view of a ferritic stainless steel according to an embodiment of the present disclosure.

Referring to FIG. 1, ferritic stainless steel according to an embodiment of the present disclosure includes a stainless base material 10 and a passivation film 30 formed on the stainless base material 10.

In stainless steel, Cr oxide (eg, $Cr_2O_3$) generated on the surface forms a passivation film to secure corrosion resistance. Oxide generated on the surface of stainless steel generally has a lower Cr concentration than that of the base metal.

On the other hand, compared to Fe, Cr has excellent electrochemical stability. Therefore, if Fe is dissolved relatively more than Cr in the passivation film region, it is possible to increase the Cr concentration of the passivation film, thereby improving the corrosion resistance of stainless steel.

In the ferritic stainless steel according to an embodiment of the present disclosure, the content of Cr weight % in the thickness region $t_2$ from the surface of the passivation film to 3 nm may satisfy 1.2 times or more than the Cr weight % content of the stainless base material.

In the present disclosure, as described above, it was attempted to secure corrosion resistance by selectively enriching Cr, which improves corrosion resistance, on the surface of ferritic stainless steel, which has lower corrosion resistance than austenitic stainless steel.

On the other hand, if the Cr content present on the surface is excessive compared to the base material, the selective elution of Fe is excessively accompanied, and in this case, there is a problem that the corrosion resistance is rather reduced due to surface damage due to the elution of Fe. Therefore, it is preferable that the Cr weight % content in the thickness region from the surface of the passivation film to 3 nm ($t_2$) is 1.2 times or more and 2.0 times or less compared to the Cr weight % content of the stainless base material.

In this way, by deriving a surface component system different from the base material component system by selective Fe metal elution on the surface of ferritic stainless steel, it is possible to secure corrosion resistance equal to or higher than that of austenitic stainless steel without adding expensive alloying elements such as Mo and Ni, or applying an additional plating process.

For example, the ferritic stainless steel according to the embodiment of the present disclosure has a pitting potential of 330 mV or more.

In addition, a passivation film thickness ti of ferritic stainless steel according to an embodiment of the present disclosure may be 3 to 5 nm.

Hereinafter, a process of manufacturing ferritic stainless steel with improved corrosion resistance according to an embodiment of the present disclosure is described.

A manufacturing method of a ferritic stainless steel with improved corrosion resistance according to an embodiment of present disclosure includes: manufacturing a stainless steel cold rolled thin plate comprising, in percent (%) by weight of the entire composition, C: 0.02% or less (excluding 0), N: 0.02% or less (excluding 0), Si: 0.5% or less (excluding 0), Mn: 0.3% or less (excluding 0), Cr: 16 to 20%, Ni: 0.4% or less (excluding 0), the remainder of iron (Fe) and other inevitable impurities; forming a chromium-enriched layer on a surface of the stainless steel; and immersing in a nitric acid or a mixed acid solution comprising nitric acid and hydrofluoric acid.

The explanation of the reason for the numerical limitation of the content of the alloy component is as described above.

The stainless steel cast plate having the above alloy composition is subjected to hot rolling, annealing, pickling, cold rolling, and annealing processes to manufacture a stainless steel cold rolled thin plate. In the cold rolling step, the stainless steel sheet having the above alloy component content is rolled using a Z-mill cold rolling machine, and then the cold rolled thin plate is annealed to form a passivation film on the surface of the cold rolled thin plate.

Through annealing heat treatment, a passivation film having a smooth surface state of several nm thickness may be formed, and Cr—Fe oxide, Mn oxide, Si oxide, etc. may be formed in the passivation film.

The ferritic stainless steel that has been cold-rolled and annealed has a lower Cr concentration on its surface than that of the base material, so it is limited in its application to interior and exterior materials of buildings exposed to corrosive conditions.

Therefore, in order to improve the corrosion resistance of the stainless steel thin plate, it is necessary to form a surface thickening layer different from the base material by maximizing the Cr content of the surface regardless of the oxide present on the above-described surface.

Accordingly, the manufacturing method of ferritic stainless steel with improved corrosion resistance according to the present disclosure may form a chromium-enriched layer on the stainless steel surface through the following process.

In the step of forming the chromium-enriched layer, the surface Cr content may be increased by electrolytic treatment in a sulfuric acid solution having a concentration of 10 to 20% or immersion in a hydrochloric acid solution having a concentration of 10 to 15%. Specifically, in a region adjacent to the surface of the stainless base material, Fe, which has low electrochemical stability, dissolves relatively more than Cr, so that Cr is concentrated on the surface of the stainless steel, thereby forming a chromium-enriched layer.

Depending on the type of acid solution, the surface Fe dissolution rate of stainless steel varies, so the surface Cr content/base material Cr content may vary.

In the present disclosure, firstly, Fe is selectively dissolved by hydrochloric acid/sulfuric acid, and secondly, a chromium-enriched layer is formed by nitric acid.

When nitric acid is used, the above-described selective dissolution of Fe does not occur compared to hydrochloric acid/sulfuric acid, but rather an oxide film is formed, and thus the effect of improving corrosion resistance by dissolving Fe/concentrating Cr cannot be derived. That is, if nitric acid is used primarily, ferritic stainless steel is immersed in nitric acid without selective dissolution of Fe to form a general film.

Electrolytic treatment in a sulfuric acid solution may be performed at a current density of 0.1 to 0.6A/cm$^2$. In addition, the temperature of the sulfuric acid solution may be 40 to 80° C.

If the concentration of the sulfuric acid solution is less than 10%, the selective dissolution of Fe on the surface may be insufficient, and if the concentration exceeds 20%, it causes surface damage and rather lowers corrosion resistance. Therefore, it is preferable to control the concentration of the sulfuric acid solution to 10 to 20%. For example, the concentration of the sulfuric acid solution may be 100 to 200 g/ℓ.

If the temperature of the sulfuric acid solution is too low, it is not easy to concentrate Cr on the surface. On the contrary, if the temperature is too high, it may cause safety concerns and damage to the surface of stainless steel, so the temperature is limited to 40 to 80° C.

In addition, if the current density is lower than 0.1 A/cm$^2$, dissolution of the passivation film may occur unevenly across the surface, and if the current density is higher than 0.6A/cm$^2$, it is difficult to expect the surface concentration effect of Cr because serious elution of the base material occurs.

Immersion in a hydrochloric acid solution may be immersed in a hydrochloric acid solution having a concentration of 10 to 15% for 20 to 40 seconds.

If the concentration of the hydrochloric acid solution is less than 10%, the selective dissolution of Fe on the surface may be insufficient, and if the concentration exceeds 15%, it causes surface damage and rather lowers the corrosion resistance. Therefore, it is preferable to control the concentration of the hydrochloric acid solution to 10 to 15%. For example, the concentration of the hydrochloric acid solution may be 100 to 150 g/ℓ.

In addition, if the immersion time is less than 20 seconds, it is not easy to concentrate Cr on the surface, and if it exceeds 40 seconds, it may cause surface damage of stainless steel.

After the step of forming the chromium-enriched layer, it may be washed with water.

Thereafter, a new passivation film is formed through the step of immersing stainless steel with a chromium-enriched layer formed thereon in an acid solution. At the initial stage of acid immersion, the selective elution of Fe of stainless steel occurs, resulting in surface Cr concentration. At the end of the acid immersion, a new oxidized passivation film is formed by concentrated Cr.

Specifically, the stainless steel may be immersed in a nitric acid solution of 10 to 20% concentration or a mixed acid solution of nitric acid of 10 to 20% concentration and hydrofluoric acid of 5% or less concentration. For example, a nitric acid of 100 to 200 g/ℓ and a hydrofluoric acid of 50 g/ℓ or less may be used as the acid solution.

At this time, the acid immersion step may be performed for 30 to 90 seconds.

If the concentration of nitric acid is too low, the effect of improving corrosion resistance decreases due to low surface Cr concentration and oxygen-related passivation film formation efficiency. If the concentration of nitric acid is excessive, the effect of thickening Cr on the surface is saturated or, on the contrary, the erosion of the stainless steel surface is severe and corrosion resistance is lowered. Therefore, it is preferable to limit the concentration of nitric acid solution to 10 to 20%.

Hydrofluoric acid increases the effect of nitric acid by helping to remove metal ions through reaction with eluted metal ions. Therefore, hydrofluoric acid may not be included if the insoluble oxide does not exist or if the effect of nitric acid can be sufficiently exhibited. If the concentration of hydrofluoric acid is too high, the erosion of the stainless steel surface becomes severe, so it is preferable to set the upper limit of the concentration of hydrofluoric acid to 5%.

In addition, when the immersion time in the acid immersion step is less than 30 seconds, it is not easy to concentrate Cr on the surface, and the effect of forming a new passivation film may be deteriorated. On the other hand, if the immersion time exceeds 90 seconds, it may cause surface damage of stainless steel.

In the ferritic stainless steel with improved corrosion resistance manufactured according to the above manufacturing method, the Cr weight % content in the thickness region from the surface of the passivation film to 3 nm may be 1.2 times or more than the Cr weight % content of the stainless base material.

Hereinafter, the present disclosure is described in more detail through examples.

For the various alloy component ranges shown in Table 1 below, ferritic stainless steel hot-rolled steel sheets were prepared by a rough rolling mill and a continuous finish rolling mill according to a conventional method, followed by continuous annealing and pickling, followed by cold rolling and cold rolling annealing. Each steel grade was melted in a vacuum to confirm the composition. Comparative Steel 4 falls within the composition range of 304 austenitic stainless steel.

TABLE 1

| | C | N | Si | Mn | Cr | Ni | Ti | Nb |
|---|---|---|---|---|---|---|---|---|
| Inventive Steel 1 | 0.015 | 0.01 | 0.44 | 0.2 | 18.5 | — | — | 0.45 |
| Inventive Steel 2 | 0.006 | 0.005 | 0.41 | 0.2 | 19.1 | 0.2 | — | — |
| Inventive Steel 3 | 0.006 | 0.007 | 0.45 | 0.2 | 19.8 | 0.3 | 0.3 | |
| Comparative Steel 1 | 0.05 | 0.04 | 0.49 | 1.06 | 18.3 | 8.1 | — | — |
| Comparative Steel 2 | 0.006 | 0.006 | 0.4 | 0.2 | 15.4 | 0.2 | — | — |

Subsequently, the cold-rolled steel sheets of Inventive Steel and Comparative Steel were subjected to a process according to the conditions shown in Table 2 below.

The Cr content in the thickness region from the stainless steel surface to 3 nm/Cr content of the base material was measured and is represented by Formula (1) in Table 2 below.

In addition, the specimens of Comparative Example and Inventive Example were immersed in 1M NaCl solution at room temperature, and the anodic polarization behavior was observed while increasing the potential at a potential scanning rate of 20 mV/min, and the potential (Pitting Potential, Epit) at which the pitting of each specimen occurred is shown in Table 2 below.

TABLE 2

| | steel grade | Manufacture process | | Formula (1) value | pitting potential (mV) |
|---|---|---|---|---|---|
| Inventive Example1 | Inventive Steel 1 | 10% Hydrochloric acid immersion, 30 seconds | 10% nitric acid immersion, 30 seconds | 1.3 | 381 |
| Inventive Example 2 | Inventive Steel 2 | 15% Sulfuric acid electrolysis, 0.15 A/cm$^2$ | 10% nitric acid immersion, 30 seconds | 1.5 | 412 |
| Inventive Example 3 | Inventive Steel 2 | 15% Sulfuric acid electrolysis, 0.35 A/cm$^2$ | 15% nitric acid immersion, 30 seconds | 1.4 | 397 |
| Inventive Example 4 | Inventive Steel 2 | 15% Sulfuric acid electrolysis, 0.15 A/cm$^2$ | 10% nitric acid immersion, 90 seconds | 1.8 | 473 |
| Inventive Example 5 | Inventive Steel 3 | 15% Sulfuric acid electrolysis, 0.55 A/cm$^2$ | 10% nitric acid immersion, 30 seconds | 1.3 | 378 |
| Inventive Example 6 | Inventive Steel 2 | 15% Sulfuric acid electrolysis, 0.25 A/cm$^2$ | 15% nitric acid immersion, 60 seconds | 1.7 | 448 |
| Inventive Example 7 | Inventive Steel 2 | 15% Sulfuric acid electrolysis, 0.15 A/cm$^2$ | Mixed acid (15% nitric acid + 1% hydrofluoric acid) immersion, 30 seconds | 1.5 | 421 |
| Inventive Example 8 | Inventive Steel 2 | Mixed acid (15% nitric acid + 1% hydrofluoric acid) immersion, 30 seconds | | 1.2 | 377 |
| Comparative Example 1 | Inventive Steel 1 | 10% Hydrochloric acid immersion, 30 seconds | | 0.6 | 298 |
| Comparative Example 2 | Inventive Steel 1 | 20% Hydrochloric acid immersion, 10 seconds | | 0.6 | 285 |
| Comparative Example 3 | Inventive Steel 2 | 15% Sulfuric acid electrolysis, 0.15 A/cm$^2$ | | 0.7 | 308 |
| Comparative Example 4 | Comparative Steel 1 | — | — | 0.6 | 326 |
| Comparative Example 5 | Comparative Steel 2 | 10% Hydrochloric acid immersion, 30 seconds | 10% nitric acid immersion, 30 seconds | 0.6 | 317 |
| Comparative Example 6 | Comparative Steel 2 | 15% Sulfuric acid electrolysis, 0.05 A/cm$^2$ | 15% nitric acid immersion, 30 seconds | 0.7 | 311 |
| Comparative Example 7 | Comparative Steel 2 | 15% Sulfuric acid electrolysis, 0.75 A/cm$^2$ | 15% nitric acid immersion, 30 seconds | 0.6 | 287 |

Comparative Example 4 does not apply the manufacturing process according to the present disclosure to Comparative Steel 1, which corresponds to the composition range of austenitic stainless steel 304. At this time, it can be confirmed that the pitting potential is 326 mV.

In the present disclosure, in order to replace austenitic stainless steel 304, which is commonly used as interior and exterior materials for buildings, it is intended to secure a pitting potential of 330 mV or more. Referring to Table 2, in the case of the above Inventive Examples, compared with Comparative Examples, it can be confirmed that the pitting potential is 330 mV or more by satisfying the alloy composition and the manufacturing process.

Specifically, Inventive Example 1 sequentially proceeded with 10% hydrochloric acid immersion and 10% nitric acid immersion, so that the content of Cr present on the surface was 1.3 times higher than that of the base material, and showed a pitting potential of 381 mV.

Inventive Examples 2 to 7 showed that the content of Cr present on the surface was 1.3 times higher than that of the base material by sequentially proceeding with sulfuric acid electrolysis and acid solution immersion, and showed a pitting potential of 330 mV or more.

Inventive Example 8 is a case where the first hydrochloric acid/sulfuric acid treatment is not performed, but is immersed in mixed acid. As described above, at the initial stage of mixed acid immersion, selective elution of Fe of stainless steel occurs, resulting in surface Cr concentration. At the end of the acid immersion, a new oxidized passivation film is formed by concentrated Cr.

Referring to Table 2, in the case of Inventive Example 8, the content of Cr present on the surface was 1.2 times that of the base material, and showed a 377 mV pitting potential and is weak, but it can be confirmed that there is an effect of selective elution of Fe in the first hydrochloric acid/sulfuric acid treatment.

As shown in Table 2, Inventive Steel 1 to 3 derived a surface component different from the base material component through Inventive Examples 1 to 8, and specifically, secured the ratio of Cr in the thickness region from the surface of the passivation film to 3 nm/Cr in the base material of 1.2 or more to secure corrosion resistance of the steel material. This is possible by concentration of Cr through selective elution of Fe through sulfuric acid electrolytic treatment or hydrochloric acid immersion.

On the other hand, Comparative Examples 1 and 2 in Table 2 show the case of hydrochloric acid immersion, and the Cr concentration on the surface is 0.6, which is lower than that of the base material, and accordingly, the pitting potential was 298 mV and 285 mV, respectively, so the target corrosion resistance could not be secured.

Through this, it can be confirmed that when only the hydrochloric acid immersion was carried out, the selective dissolution of only Fe did not occur, and the simultaneous dissolution of Fe and Cr occurred, and thus the chromium-enriched layer on the surface was not formed.

In Comparative Example 3, only sulfuric acid electrolysis was performed, and the Cr concentration on the surface was 0.7, which is lower than that of the base material. Accordingly, the pitting potential also appeared to be 308 mV, and the target corrosion resistance could not be secured.

Although the process proposed by the present disclosure, 10% hydrochloric acid immersion and 10% nitric acid immersion were sequentially carried out, Comparative Example 5 shows that the Cr concentration of the surface is 0.6, which is lower than that of the base material. As a result, the pitting potential appeared to be 317 mV, and the target corrosion resistance could not be secured. Through this, it can be confirmed that the Cr content of Comparative Steel 2 is 15.4%, which is less than the range of Cr content in the present disclosure, so that sufficient Cr concentration has not occurred on the surface.

Comparative Example 6 and Comparative Example 7 are cases where the current density of sulfuric acid electrolysis is lower than 0.1 $A/cm^2$ or higher than 0.6 $A/cm^2$. Therefore, the Cr concentration of the surface was 0.6 and 0.7, which was lower than that of the base material, and thus the pitting potential was also 311 mV and 287 mV, so that the target corrosion resistance could not be secured.

FIG. 2 is a view showing a surface state after a salt spray test of an Inventive Steel and a Comparative Steel according to an embodiment of the present disclosure. Referring to FIG. 2, in the case of Inventive Example 4 compared to Comparative Example 4, by sequentially performing sulfuric acid electrolysis and nitric acid solution immersion, the Cr concentration on the surface was increased to 1.8 compared to the Cr concentration of the base metal, and it was confirmed that corrosion resistance was improved.

As described, for the ferritic stainless steel with improved corrosion resistance manufactured according to the embodiment of the present disclosure, by deriving a surface component system different from the base material component system by selective Fe metal elution on the surface of stainless steel, it is possible to secure corrosion resistance equal to or higher than that of austenitic stainless steel without adding expensive alloying elements such as Mo, Ni, or applying an additional plating process .

While the present disclosure has been particularly described with reference to exemplary embodiments, it should be understood by those of skilled in the art that various changes in form and details may be made without departing from the spirit and scope of the present disclosure.

INDUSTRIAL APPLICABILITY

According to the present disclosure, it is possible to secure corrosion resistance equal to or higher than that of austenitic stainless steel without adding expensive alloy elements or plating by concentrating Cr on the surface while using ferritic stainless steel with high price competitiveness.

The invention claimed is:

1. A ferritic stainless steel comprising:

a stainless base material comprising, in percent (%) by weight of the entire composition, C: 0.02% or less (excluding 0), N: 0.02% or less (excluding 0), Si: 0.5% or less (excluding 0), Mn: 0.2% to 0.3%, Cr: 16% to 20%, Ni: 0.2% to 0.4%, and the remainder of iron (Fe) and inevitable impurities; and a passivation film formed on the stainless base material, and wherein a Cr weight % content of a thickness region from a surface of the passivation film to 3 nm is 1.2 times or more than the Cr weight % content of the stainless base material.

2. The ferritic stainless steel of claim 1, further comprising:

at least one of Ti: 0.4% or less and Nb: 0.5% or less.

3. The ferritic stainless steel of claim 1, wherein the ferritic stainless steel has a pitting potential of 330 mV or more.

4. The ferritic stainless steel of claim 1, wherein a thickness of the passivation film is 3 to 5 nm.

5. A method of manufacturing the ferritic stainless steel of claim 1, the method comprising:

manufacturing a stainless steel comprising, in percent (%) by weight of the entire composition, C: 0.02% or less (excluding 0), N: 0.02% or less (excluding 0), Si: 0.5% or less (excluding 0), Mn: 0.2% to 0.3%, Cr: 16 to 20%, Ni: 0.2% to 0.4%, the remainder of iron (Fe) and other inevitable impurities;

forming a chromium-enriched layer on a surface of the stainless steel; and immersing in nitric acid or mixed acid solution comprising nitric acid and hydrofluoric acid.

6. The method of claim 5, wherein the forming of the chromium-enriched layer comprises:

performing electrolytic treatment in sulfuric acid solution having a concentration of 10 to 20%.

7. The method of claim 6, wherein a current density of the electrolytic treatment is 0.1 to 0.6 $A/cm^2$.

8. The method of claim 5, wherein the forming of the chromium-enriched layer comprises:

immersing in hydrochloric acid solution at concentration of 10 to 15% for 20 to 40 seconds.

9. The method of claim 5, wherein a concentration of the nitric acid solution is 10 to 20%.

10. The method of claim 5, wherein the mixed acid solution is prepared with nitric acid at concentration of 10 to 20% and hydrofluoric acid at concentration of 5% or less.

* * * * *